US009231337B2

(12) United States Patent
Sakakura

(10) Patent No.: US 9,231,337 B2
(45) Date of Patent: Jan. 5, 2016

(54) CONNECTOR AND MOUNTING METHOD THEREFOR

(71) Applicant: Sumitomo Wiring Systems, Ltd., Yokkaichi (JP)

(72) Inventor: Kouji Sakakura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 107 days.

(21) Appl. No.: 13/909,761

(22) Filed: Jun. 4, 2013

(65) Prior Publication Data

US 2013/0333944 A1 Dec. 19, 2013

(30) Foreign Application Priority Data

Jun. 14, 2012 (JP) ..... 2012-134886

(51) Int. Cl.

*H01R 13/58* (2006.01)
*H01R 13/516* (2006.01)
*H01R 13/533* (2006.01)
*H01R 13/74* (2006.01)

(52) U.S. Cl.

CPC ..... *H01R 13/5804* (2013.01); *H01R 13/5837* (2013.01); *H01R 13/748* (2013.01); *H01R 2201/26* (2013.01)

(58) Field of Classification Search

CPC .. H01R 9/038; H01R 13/6593; H01R 13/516; H01R 13/73; H01R 13/6581; H01R 13/582; H01R 13/5804; H01R 13/5837; H01R 4/12; H01R 13/60; H01R 13/533

USPC ..... 439/382–385, 2, 380, 478, 519, 439/527–576, 579, 582, 607.25, 607.01, 439/634, 638, 660, 680, 585, 690, 445, 448, 439/464, 459, 460, 456, 607, 470, 465, 471, 439/345

See application file for complete search history.

(56) References Cited

U.S. PATENT DOCUMENTS

| | | | | |
|---|---|---|---|---|
| 3,794,960 | A | 2/1974 | Sugar | |
| 4,160,572 | A | 7/1979 | Adelberger et al. | |
| 4,842,549 | A * | 6/1989 | Asick et al. | 439/464 |
| 5,700,156 | A | 12/1997 | Bussard et al. | |
| 5,897,392 | A * | 4/1999 | Takahashi et al. | 439/470 |
| 5,997,349 | A | 12/1999 | Yoshioka | |
| 6,422,885 | B2 * | 7/2002 | Kain et al. | 439/247 |
| 6,540,547 | B2 * | 4/2003 | Zweigle | 439/468 |

(Continued)

FOREIGN PATENT DOCUMENTS

| | | |
|---|---|---|
| GB | 2461372 | 1/2010 |
| JP | 2007227256 | 9/2006 |

*Primary Examiner* — James Harvey
*Assistant Examiner* — Matthew T Dzierzynski
(74) *Attorney, Agent, or Firm* — Gerald E. Hespos; Michael J. Porco; Matthew T. Hespos

(57) ABSTRACT

A connector (10) to be mounted on ends of wires (W1) to be installed in a vehicle includes female terminals (20) that are to be connected to the ends of the wires, a housing (30) in which the female terminals (20) are accommodated and from which the wires (W1) are drawn out, and a shield bracket (40) that fixes the housing (30) to a case of a device installed in the vehicle. The shield bracket (40) includes a wire fixing portion (54) between a wire draw-out part (P1) where the wires (W1) are drawn out from the housing (30) and a vibrating part (P2). The wire fixing portion (54) fixes the wires (W1) extending in a direction intersecting an extending direction of the wires (W1) in the vibrating part (P2) where the wires (W1) vibrate as the vehicle vibrates.

9 Claims, 18 Drawing Sheets

(56) References Cited

U.S. PATENT DOCUMENTS

| | | | | |
|---|---|---|---|---|
| 7,772,498 | B2 * | 8/2010 | Kobayashi et al. | 174/135 |
| 8,128,440 | B2 * | 3/2012 | Matsumoto et al. | 439/731 |
| 2002/0155751 | A1 | 10/2002 | Kato | |
| 2011/0195596 | A1 | 8/2011 | Sakakura et al. | |
| 2012/0184125 | A1 * | 7/2012 | Suzuki et al. | 439/345 |
| 2012/0184152 | A1 * | 7/2012 | Kataoka et al. | 439/660 |
| 2012/0238130 | A1 * | 9/2012 | Osawa et al. | 439/460 |
| 2013/0316573 | A1 * | 11/2013 | Uno et al. | 439/573 |

* cited by examiner

CONNECTOR AND MOUNTING METHOD THEREFOR

BACKGROUND OF THE INVENTION

1. Field of the Invention

The invention relates to a connector.

2. Description of the Related Art

U.S. Pat. No. 5,997,349 discloses a connector to be mounted on an end of a wire. This connector includes a terminal fitting connected to the end of the wire and a housing formed with a cavity. The terminal fitting is fit into the cavity from behind. The housing has a front stop to limit forward movement of the terminal into the housing and a locking lance to retain the terminal fitting in the housing.

A clearance is unavoidable between the terminal fitting and the inner wall of the cavity and hence the terminal fitting shakes slightly in the cavity. A connector mounted to a wiring harness installed in a vehicle is subject to vibration as the vehicle runs. Thus, terminal fittings shake in forward and backward directions in the cavity even after the connector is connected to a mating connector. As a result, sliding abrasion occurs between connecting parts of the terminal fittings and connection reliability is reduced.

The invention was completed in view of the above situation and an object thereof is to suppress sliding movements between terminal fittings and improve connection reliability between the terminal fittings by preventing the shaking of wires.

SUMMARY OF THE INVENTION

The invention relates to a connector to be mounted on an end of a wire to be installed in a vehicle. The connector has a housing and at least one terminal fitting accommodated in the housing. The terminal fitting is connected to the end of the wire, and the wire is drawn out from the housing. A bracket is provided for fixing the housing to a case of a device installed in the vehicle. The bracket includes a wire fixing portion for fixing the wire between the housing and a vibrating part that vibrates as the vehicle operates. More particularly, the wire fixing portion fixes a part of the wire that extends in a direction intersecting an extending direction of the wire in the vibrating part, thereby suppressing transmission of vibrations from the vibrating part to the connector. As a result, the wire fixing portion suppresses shaking of the terminal fitting in the housing and limits sliding movements between terminal fittings. Consequently, connection reliability is improved.

The wire fixing portion may fix the wire by tightening the wire. Thus, the wire can be fixed reliably to the wire fixing portion without being affected by the thickness of the wire and the transmission of vibration from the vibrating part to the wire draw-out part can be suppressed reliably. Further, it is not necessary to change the shape of the wire fixing portion according to the thickness and the like of the wire and it is possible to reduce a burden in parts management and manufacturing cost.

The wire fixing portion preferably fixes the wire extending in a direction intersecting an insertion direction of the terminal fitting into the housing. Thus, any vibrations of the vibrating part that are transmitted beyond the wire fixing portion are not likely to generate sliding movement of the terminal fitting along the inserting direction of the terminal fitting. As a result, sliding movements between the terminal fittings are suppressed.

A cover may be attached to the bracket for covering and protecting the wire draw-out part of the housing. The wire fixing portion may be integral or unitary with the cover. Thus, transmission of vibration from the vibrating part to the wire draw-out part can be suppressed by the cover that protects the wire, thereby reducing manufacturing cost more than if the cover and the wire fixing portion were provided separately.

The cover may cover a part of the housing from the wire draw-out part to the wire fixing portion. Thus, the wire fixing portion and the wire are less likely to deteriorate due to exposure to the elements. Vibrations caused by a reduced fixing force resulting from a deteriorated wire fixing portion or a deteriorated wire are avoided.

The bracket may be fixed to the case by tightening at least one tightening member into the case, and the cover may be fixed to the case by being tightened together with the bracket by the tightening member. Accordingly, it is not necessary to provide a separate part for attaching the cover to the bracket. Further, the cover and the bracket can be assembled with the case by one tightening operation, thereby reducing the manufacturing cost and the number of operation steps for assembling the connector.

The bracket may include a mounting seat for attaching the cover to the bracket in advance before the bracket is attached to the case. Thus, the connector can be transported with the cover and the wire fixing portion attached to the bracket. As a result, parts management is more efficient and the connector is not likely to be damaged by the wire drawn out from the housing being caught by another member.

The bracket may be a shield bracket.

These and other features of the invention will become more apparent upon reading the following detailed description. Even though embodiments are described separately, single features may be combined to additional embodiments.

DETAILED DESCRIPTION OF THE PREFERRED EMBODIMENTS

A connector in accordance with a first embodiment of the invention is identified by the numeral 10 in FIGS. 1 to 10. The connector 10 is connected to ends of wires W1 to be arranged in a vehicle and to be mounted on a case (not shown) of a device in the vehicle.

Figure 10:
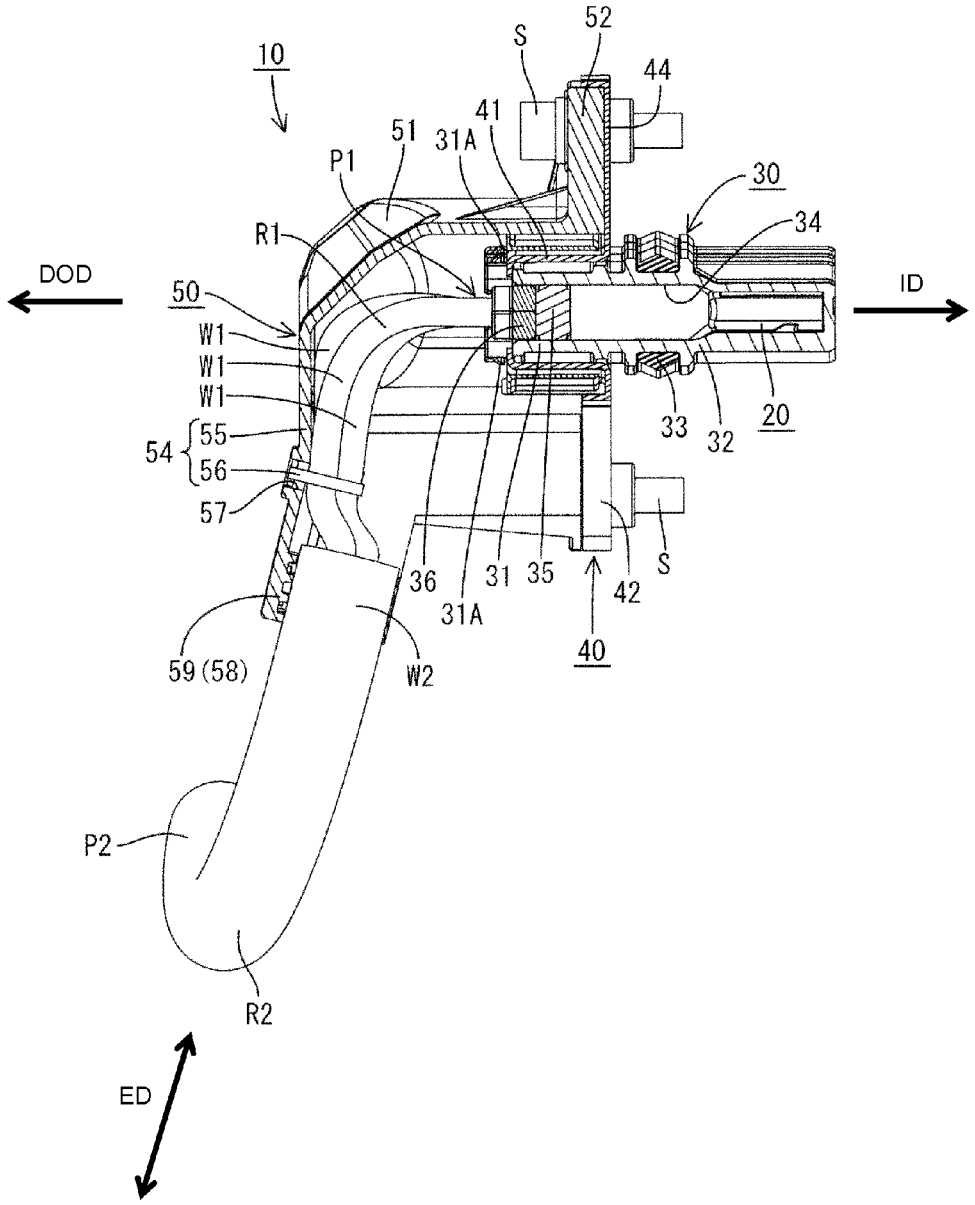
FIG. 10 is a section along A-A of FIG. 8.

As shown in FIG. 10, the connector 10 includes female terminals 20 to be connected to the ends of the wires W1, a housing 30 made e.g. of synthetic resin to accommodate the female terminals 20, a shield bracket 40 made of conductive metal and configured to at least partly cover the housing 30 and a cover 50 made e.g. of synthetic resin and to be attached to the shield bracket 40. In the following description, reference to the vertical direction is based on FIGS. 2, 4 and 10, forward and backward directions are based on FIG. 10, and a side to be mounted on the case of the device (shown right side in FIG. 10) is referred to as the front.

Figure 7:
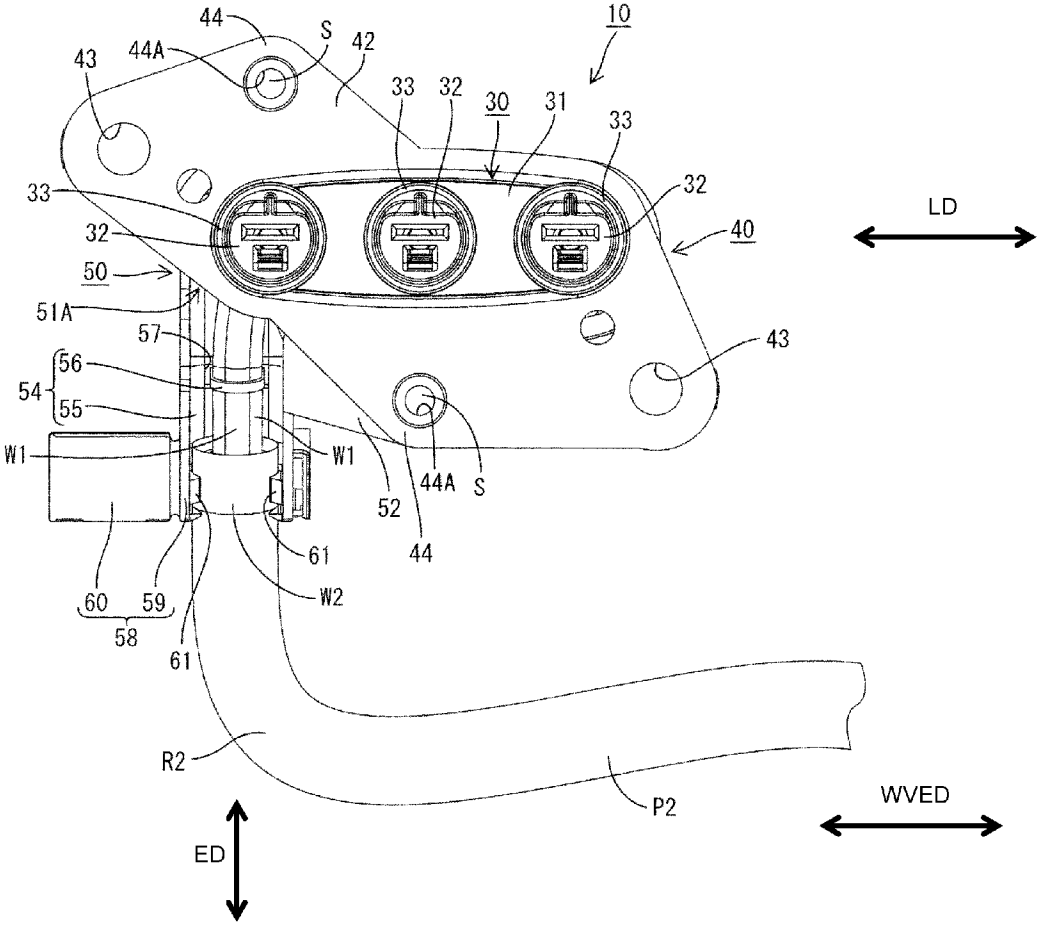
FIG. 7 is a front view showing a state where a covering member covering wires is pulled out from a connector according to the first embodiment.

The wires W1 are covered by a covering member W2, as shown in FIGS. 7, and 10, and a plurality of wires W1 covered by the covering member W2 are arranged in a vehicle. The wires W1 are exposed at an end of the covering member W2 and the respective female terminals 20 are crimped and connected to cores exposed by stripping coatings of the respective wires W1 so that the female terminals 20 are connected electrically to the respective wires W1.

Figure 1:
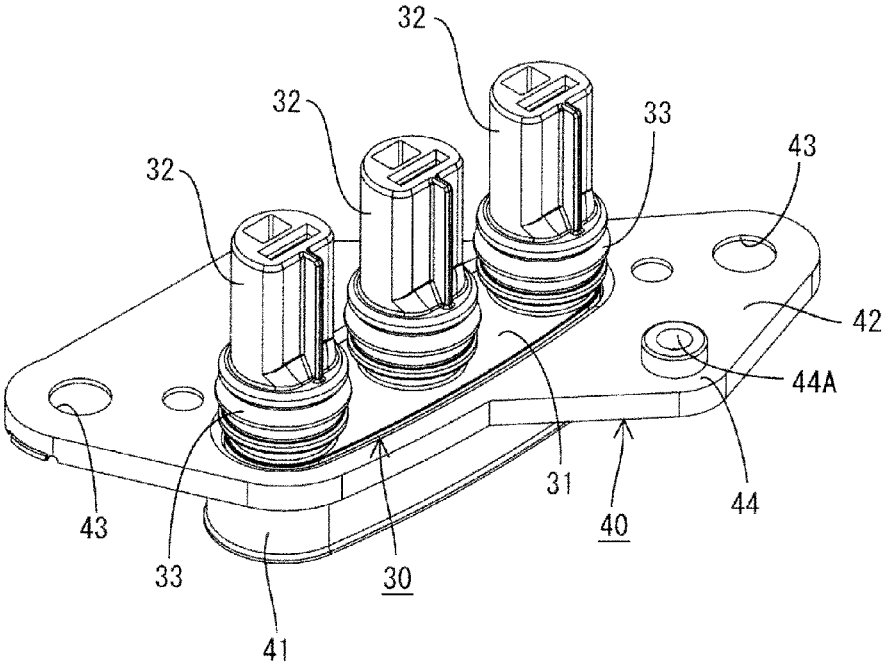
FIG. 1 is a perspective view showing a state where a shield bracket is mounted on a housing according to a first embodiment.
Figure 2:
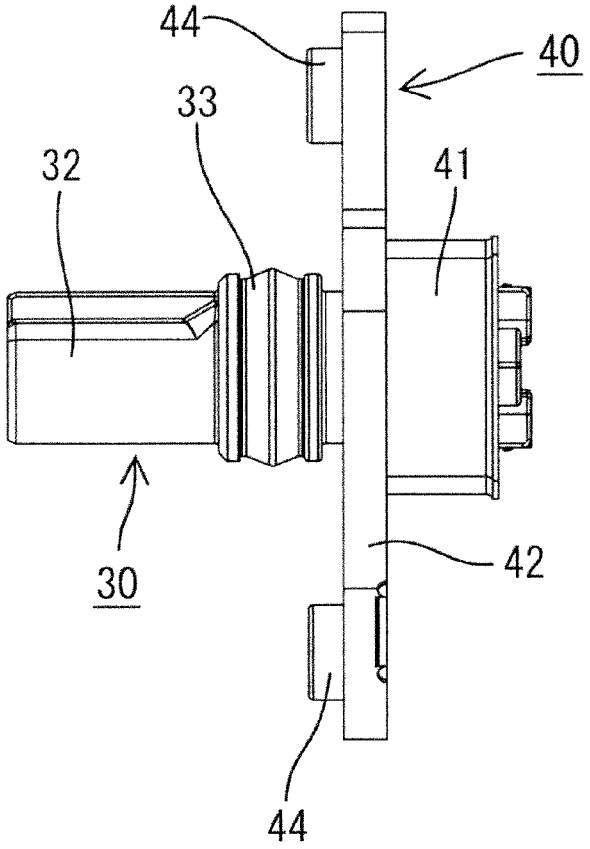
FIG. 2 is a side view showing the state of FIG. 1.
Figure 3:
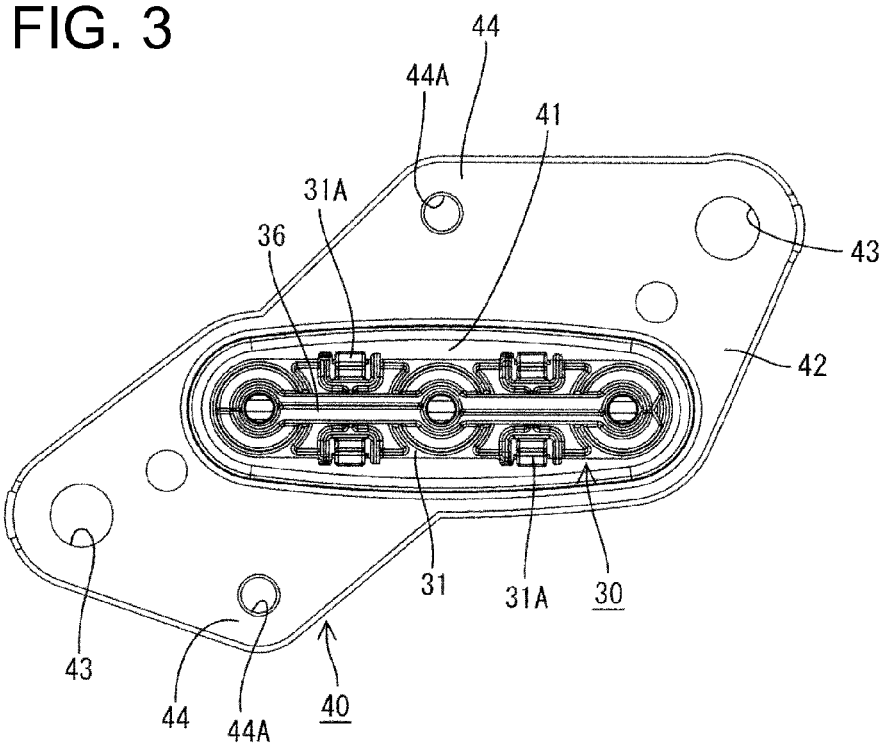
FIG. 3 is a rear view showing the state of FIG. 1.

As shown in FIGS. 1 to 3, the housing 30 includes a wide elliptical main body 31 and three fittings 32 unitary with the main body 31. The fittings 32 are arranged side by side in the lateral direction LD and each fitting 32 extends forward from the front surface of the main body 31. A substantially cylindrical seal 33 is mounted on the outer periphery of each fitting 32 for sealing between a mating connector and the fitting 32 when the connector 10 is connected to the mating connector.

A cavity 34 penetrates through the fitting 32 in forward and backward directions, as shown in FIG. 10. The female terminal 20 connected to the wire W1 is inserted into the cavity 34 from behind and the wire W1 is drawn out backward from a rear end of the main body 31. A draw-out direction DOD of the wire W1 and an insertion direction ID of the female terminal 20 into the cavity 34 are substantially the same or parallel to each other.

The female terminal 20 is to be connected electrically to a mating terminal (not shown) in the mating connector when the fitting 32 and the mating connector are connected. Further, a locking lance (not shown) formed in the cavity 34 is fit into a locking hole (not shown) in the female terminal 20 to retain the female terminal 20 so as not to come out backward. Note that a small clearance exists between the locking lance and the locking hole to enable the locking lance to be fit smoothly into the locking hole.

A rubber ring 35 is mounted in a rear end part of the cavity 34 and is retained by a seal ring 36 so as not to come off backward. The rubber ring 35 is held in close contact with the inner peripheral surface of the cavity 34 and the outer peripheral surface of the wire W1 to provide sealing between the cavity 34 and the wire W1.

The shield bracket 40 is formed by press-working or stamping a conductive metal plate material, and, as shown in FIGS. 2 and 10, includes a tubular portion 41 to be fit externally on the main body 31 to cover the housing main body 31 over the substantially the entire periphery and a flange 42 projecting out from a front end of the tubular portion 41.

The tubular portion 41 is mounted onto the main body 31 from behind and a rear end part of the tubular portion 41 is locked by a plurality of locking portions 31A on the rear part of the main body 31. Thus, the shield bracket 40 is fixed so as not to come off the main body 31. Further, a shield layer, such as braided wire (not shown) can be crimped or otherwise connected to the outer periphery of the tubular portion 41 and collectively covers the wires W drawn out from the main body 31 for shielding the wires W1 together.

Figure 8:
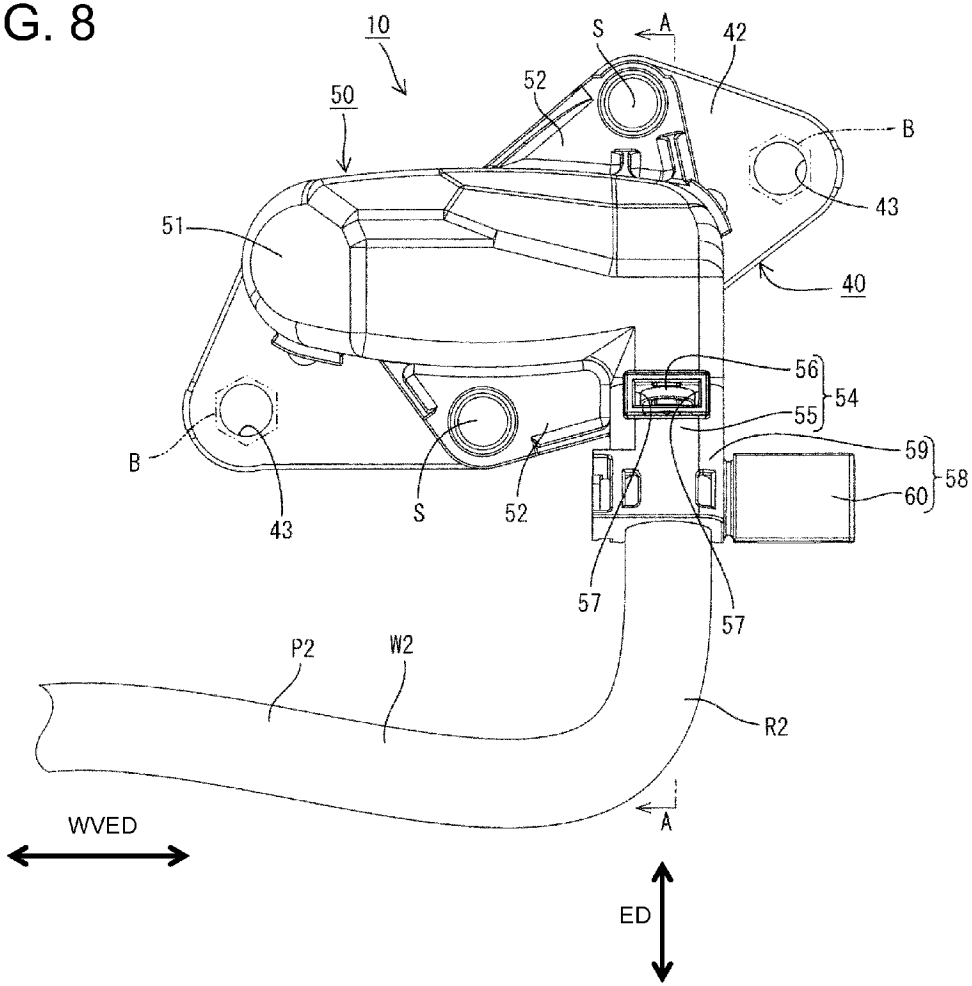
FIG. 8 is a rear view showing the state of FIG. 7.

The flange 42 is formed with bolt insertion holes 43. The shield bracket 40 is fixed to the case by inserting bolts or other tightening or fixing members B through the bolt insertion holes 43 and tightening them into the case, as shown in FIG. 8.

Figure 9:
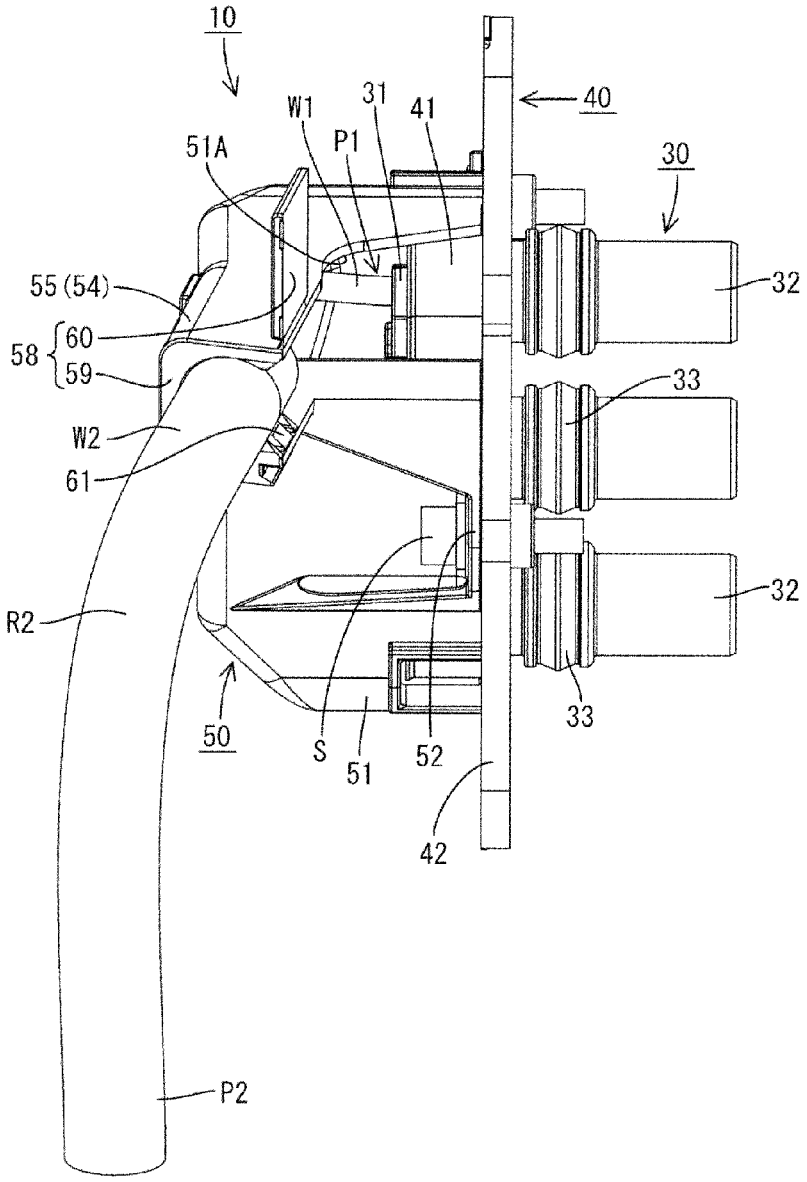
FIG. 9 is a bottom view showing the state of FIG. 7.

As shown in FIGS. 9 and 10, the cover 50 includes a covering portion 51 for covering a wire draw-out part P1 where the wires W1 are drawn out from the main body 1 from behind at the rear of the main body 31. Upper and lower bulges 52 bulge out from the upper and lower edges of the covering portion 51.

Each bulge 52 has a screw insertion hole 53 for receiving a screw S. On the other hand, the flange 42 of the shield bracket 40 has mounting seats 44 at positions corresponding to the screw insertion holes 53 in the bulges 52, and a screw hole 44A penetrates through each mounting seat 44 in forward and backward directions. The shield bracket 40 is assembled with the cover 40 so that the bulges 52 correspond to the mounting seats 44, and the screws S are inserted through the screw insertion holes 53 and screwed into the screw holes 44A of the mounting seats 44 for fixing the cover 50 to the shield bracket 40. The cover 50 can be fixed to the shield bracket 40 in advance and before the shield bracket 40 is fixed to the case of the device. Accordingly, parts management is improved by transporting the housing 30 assembled with the shield bracket 40 and preventing the connector 10 from being damaged due by contact of other members with the wires W1 drawn out from the housing main body 31 during transportation of the connector 10.

The covering portion 51 is a forwardly open receptacle and protects substantially the entire wire draw-out part P1 of the housing main body 31 by accommodating the tubular portion 41 of the shield bracket 40 together with the housing main body 31 of the housing 30 from behind. Thus, even if the connector 10 is exposed to the elements, rain and mud will not adhere to the wires W1 and the housing 30 and will not deteriorate the wires W1 and the housing 30.

Figure 4:
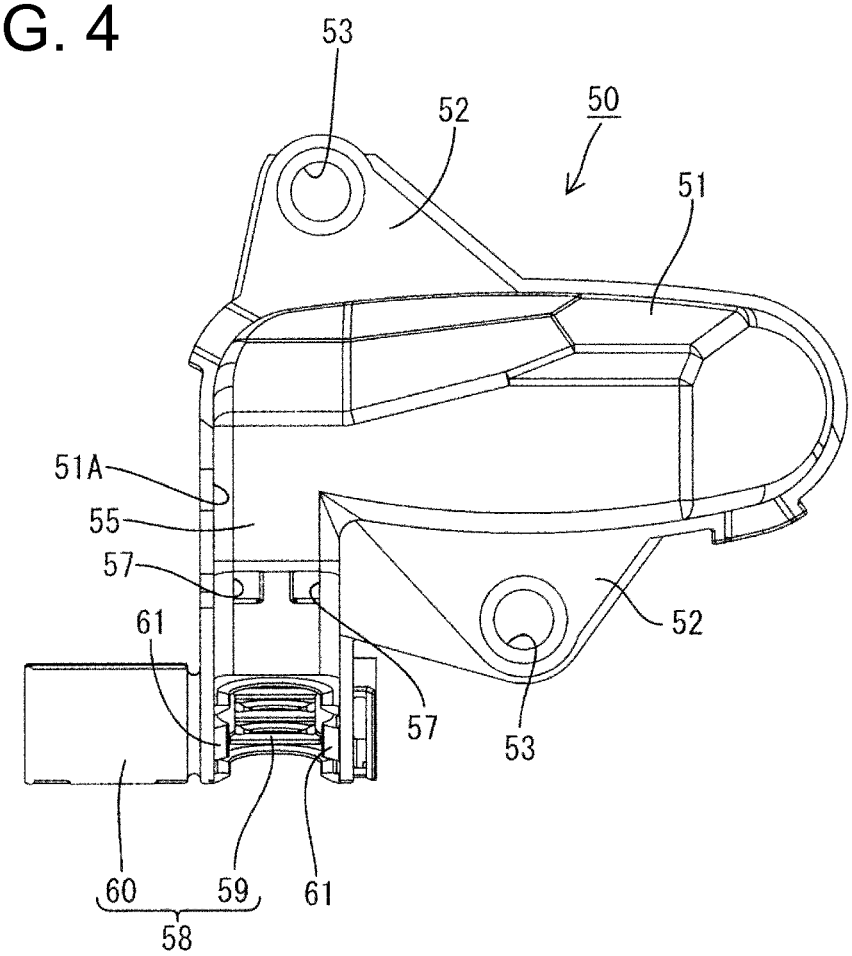
FIG. 4 is a front view of a cover according to the first embodiment.
Figure 5:
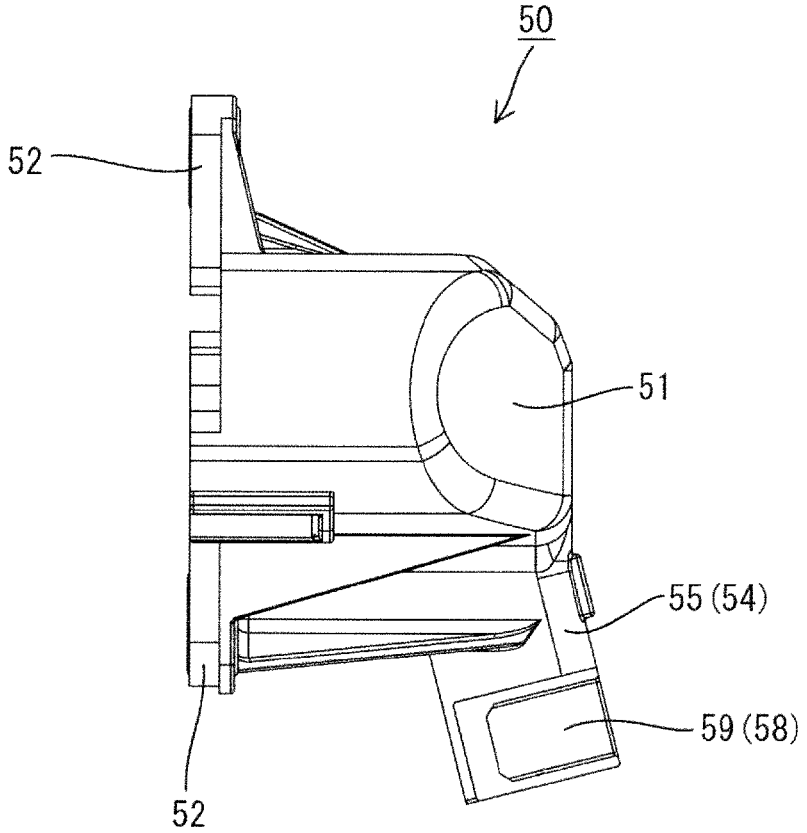
FIG. 5 is a side view of the cover.
Figure 6:
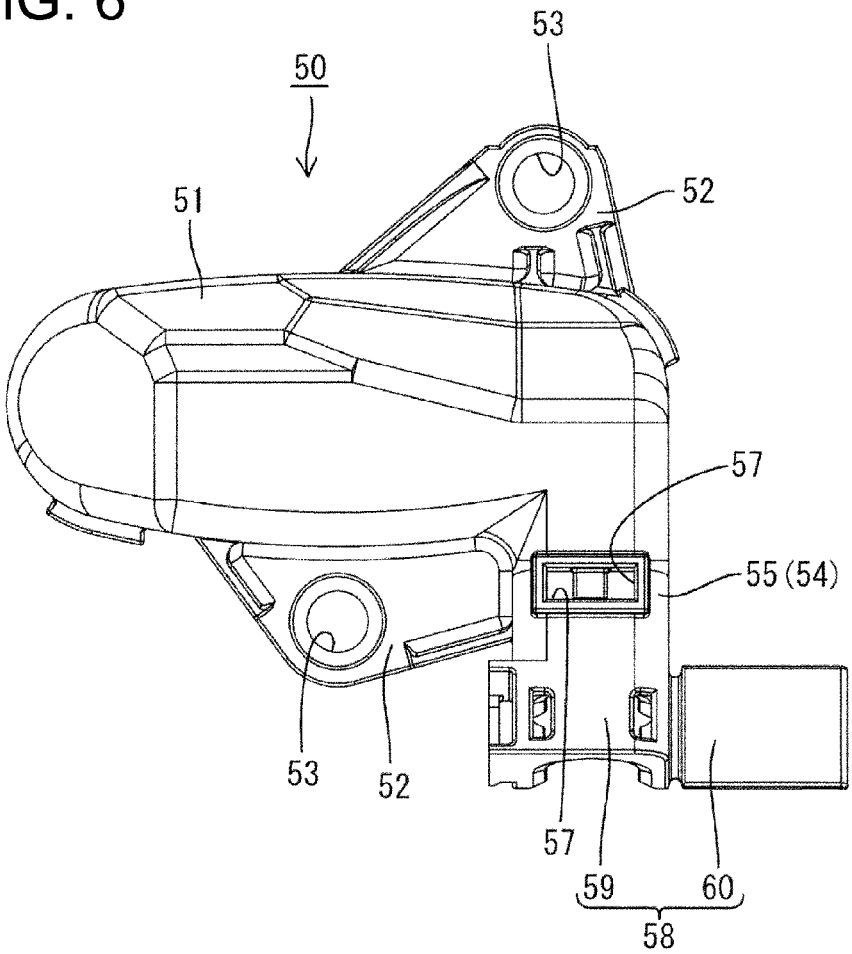
FIG. 6 is a rear view of the cover.

As shown in FIGS. 4,7 and 9, the covering portion 51 includes a lower opening 51A through which the wires W1 are drawn out while being bent in an extending direction ED substantially perpendicular to the draw-out direction DOD of the wires W1 drawn out backward from the main body 31 at the wire draw-out part P1. The wires W1 extend down in the extending direction ED a short distance from the lower opening 51A, and then the wires W1 covered together by the covering member W2 are bent substantially normal to the right and extend in the lateral direction LD in the vehicle.

As shown in FIG. 7, the cover 50 includes a wire fixing portion 54 for collectively bundling and fixing the wires W1 drawn out from the lower opening 51A of the covering portion 51 and extending in the extending direction ED. The wire fixing portion 54 is on a lower part of the covering portion 51 and includes a support recess 55 extending out and down from the lower part of the covering portion 51. The support recess 55 is a forwardly open half cylinder that is unitary with the covering portion 51. A tightening band 56 made e.g. of synthetic resin is configured to tighten the plurality of wires W1 together. That is, the wire fixing portion 54 is below parts R1 of the wires W1 drawn out from the main body 31 in the draw-out direction DOD and above parts R2 of the wires W1 bent to extend in the lateral direction LD in the vehicle.

The wires W1 drawn out from the covering portion 51 and extending down in the extending direction ED are arranged on the inner side of the support recess 55 and, as shown in FIG. 8, left and right band insertion holes 57 are provided in the rear wall of the support recess 55. The tightening band 56 is inserted through the band insertion holes 57 of the support recess 55 and collectively tightens the wires W1 to the rear wall of the support recess 55 so that the wires W1 are fixed firmly in the support recess 55. The wires W1 drawn out in the extending direction ED from the covering portion 51 are fixed firmly by the wire fixing portion 54 while extending in the extending direction ED substantially perpendicular to the draw-out direction DOD of the wires W1 from the main body 31 and substantially perpendicular to a wire vehicle extension direction WVED (i.e. the lateral direction LD) in which the wires W1 in the vehicle extend.

A wire holding portion 58 is provided for holding the covering member W2 on the wires W1 against a lower part of the wire fixing portion 54. The wire holding portion 58 includes a groove 59 and a retaining portion 60. The groove 59 is continuous with the support recess 55 and opens forward like the support recess 55. Left and right holding projections 61 are provided on the front opening edges of the groove 59 and have shapes that conform with the shape of the covering member W2. Thus, the holding projections 61 hold covering member W2 in the groove 59 of the wire holding portion 58.

The retaining portion 60 is hinged to one front opening edge of the groove 59 and can be rotated toward and locked to the other front opening edge of the groove 59 after the covering member W2 is press-fit into the groove 59. Thus, the wire holding portion 58 fixes the covering member W2 of the wires W1 while the wire fixing portion 54 fixes parts of the wires W1 that extend beyond the covering member W2.

The connector 10 is fixed to the case of the device installed in the vehicle, and the wires W1 drawn out from the connector 10 in the extending direction ED are bent laterally from the extending direction ED to extend in the wire vehicle extension direction WVED while being covered by the covering member W2, as shown in FIG. 8.

The wires W1 that extend in the wire vehicle extension direction WVED in the vehicle vibrate in the wire vehicle extension direction WVED together with the covering member W2 as the vehicle runs. Vibration from a vibrating part P2 where the wires W1 vibrate in the wire vehicle extension direction WVED (i. e. the lateral direction LD) affects the connector 10 connected to the ends of the wires W1. Thus, if wires drawn out from a housing are arranged in a vehicle without being fixed to a cover or the like, vibration from a vibrating part is transmitted directly to female terminals of a connector and the female terminals shake in forward and backward directions in cavities, thereby causing sliding movements between the female terminals and mating terminals. The wires can be fixed to a cover, such as by a tightening band. However, the wires still will shift laterally in the tightening band and vibration from the vibrating part is transmitted to the female terminals if the vibration from the vibrating part increases when the wires are fixed while extending in the same lateral direction as the direction of the vibration transmitted from the vibrating part. This results in sliding movements between the female terminals and the mating terminals.

However, the wire fixing portion 54 is between the wire draw-out part P1 of the main body 31 where the wires W1 are drawn out and the vibrating part P2. The wire fixing portion 54 firmly fixes the wires W1 extending in the wire vehicle extension direction WVED. That is, the wires W1 are fixed while extending in the extending direction ED, which is a substantially perpendicular direction that is capable of canceling lateral vibration. As a result, substantially lateral vibration from the vibrating part P2 to the wire draw-out part P1 is suppressed. Further, the tightening band 56 is tightened in a radial direction of the wires W1 and fixes the wires W1 arranged in the extending direction ED in the wire fixing portion 54. Accordingly, the wires W1 are not shifted in the vibrating direction (the wire vehicle extension direction WVED). This is unlike the case where wires are fixed while extending in the vibrating direction. Therefore, lateral vibration from the vibrating part P2 is suppressed reliably. In this way, sliding movements between the female terminals 20 and the mating terminals are suppressed and connection reliability between the terminals is improved. Further, the wires W1 are fixed by the tightening band 56, and it is not necessary to change the shape of the wire fixing portion 54 according to the thickness and number of the wires W1. Therefore, parts management is facilitated and manufacturing cost is reduced.

The wires W1 are fixed in the wire fixing portion 54 so that the extending direction ED of the wires W1 in the wire fixing portion 54 and the draw-out direction DOD of the wires W1 drawn out from the main body 31 are at an angle and preferably substantially perpendicular. Thus, even if lateral vibration from the vibrating part P2 is transmitted beyond the wire fixing portion 54, the lateral vibration transmitted from the wire fixing portion 54 is canceled or strongly reduced and the transmission of vibrations to the wires W1 drawn out from the housing main body 31 in forward and backward directions can be suppressed further. Specifically, shake of the female terminals 20 in the insertion direction ID of the female terminals 20 in the housing 30 is suppressed reliably. Therefore, sliding movements between the female terminals 20 and the mating terminals is suppressed further, thereby improving connection reliability between the terminals.

Further, the cover 50 has both a protection function of protecting the wire draw-out part P1 and a wire fixing function of fixing the wires W1 by providing the cover 50 for protecting the wire draw-out part P1 with the wire fixing portion 54. Thus, manufacturing cost can be reduced as compared with the case where a cover for protecting the wire draw-out part P1 and a wire fixing portion for fixing the wires W1 are provided separately.

A connector in accordance with a second embodiment of the invention is identified by the number 110 in FIGS. 11 to 18. The connector 110 of the second embodiment differs from the first embodiment with respect to the shape of the flange 42 of the shield bracket 40, the shapes of the wire fixing portion 54 and the wire holding portion 58 of the cover 50 and the shapes of the bulging portions 52 of the cover 50, as shown in FIGS. 14 to 18. The components, functions and effects common or similar to the first embodiment are not repeatedly described. Further, the similar or substantially same components as in the first embodiment are denoted by the same reference signs.

Figure 11:
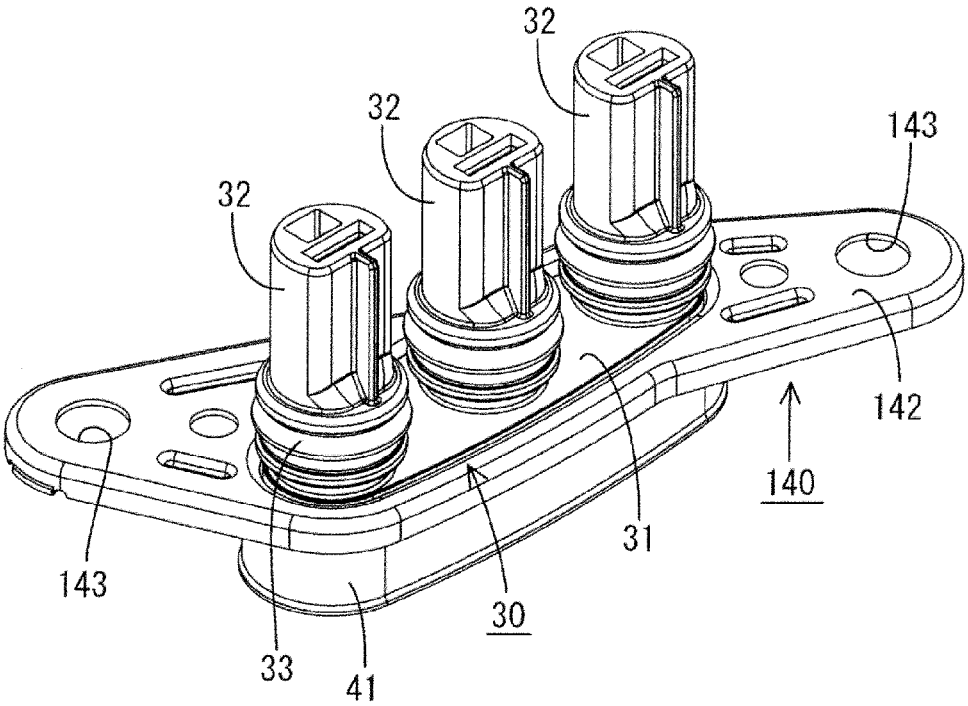
FIG. 11 is a perspective view showing a state where a shield bracket is mounted on a housing according to a second embodiment.
Figure 12:
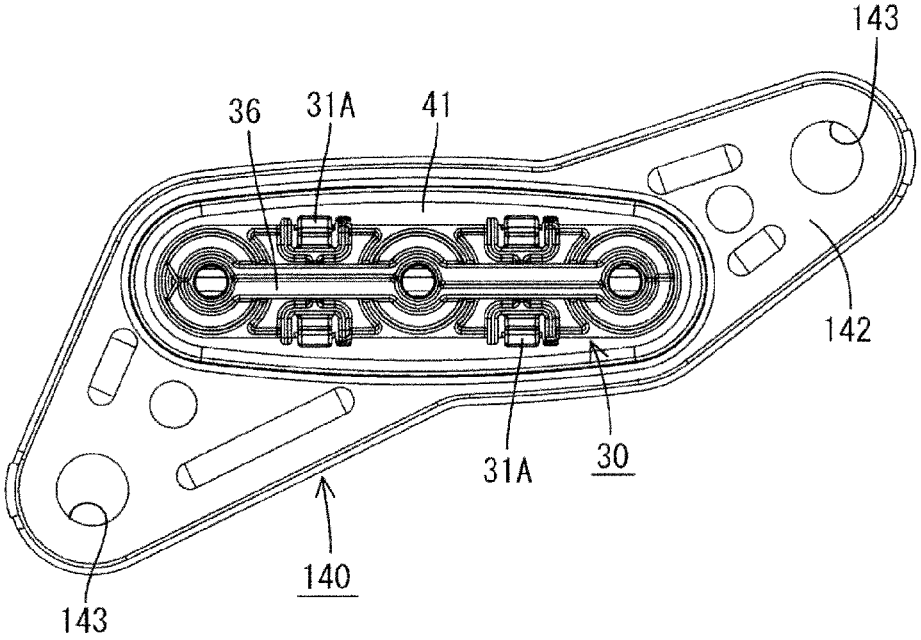
FIG. 12 is a rear view showing the state of FIG. 11.

As shown in FIGS. 11 and 12, a flange 142 of a shield bracket 140 of the second embodiment is smaller than the flange 42 of the first embodiment by being formed with fewer bolt insertion holes 143 (e.g. only with two bolt insertion holes 143) and omitting the mounting seats 44 of the first embodiment.

Figure 13:
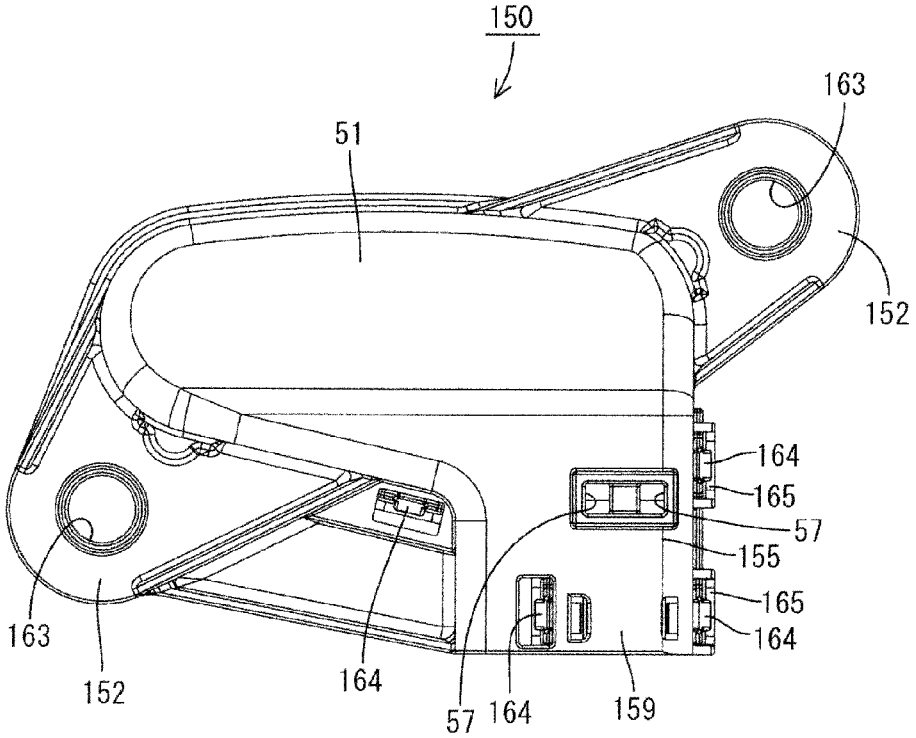
FIG. 13 is a rear view of a cover according to the second embodiment.
Figure 14:
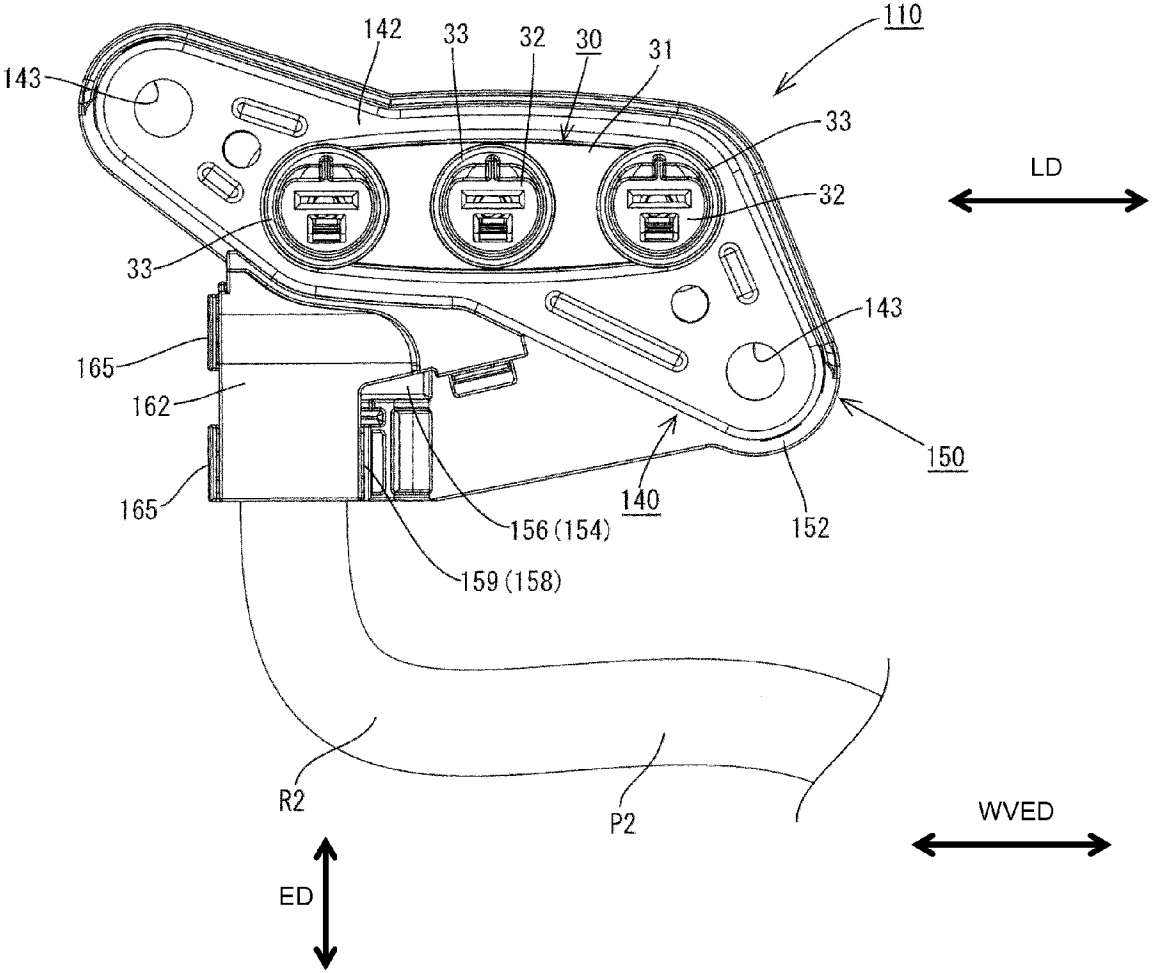
FIG. 14 is a front view showing a state where a covering member covering wires is pulled out from a connector according to the second embodiment.
Figure 15:
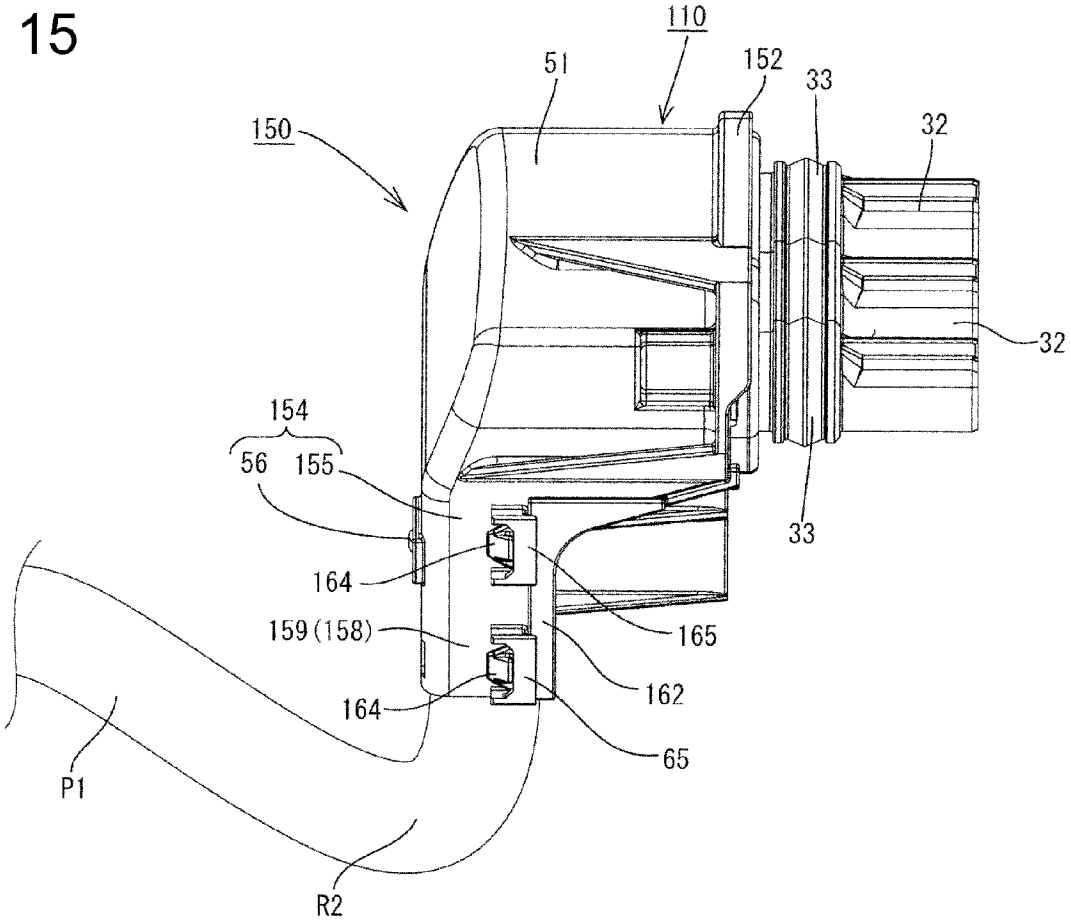
FIG. 15 is a side view showing the state of FIG. 14.
Figure 16:
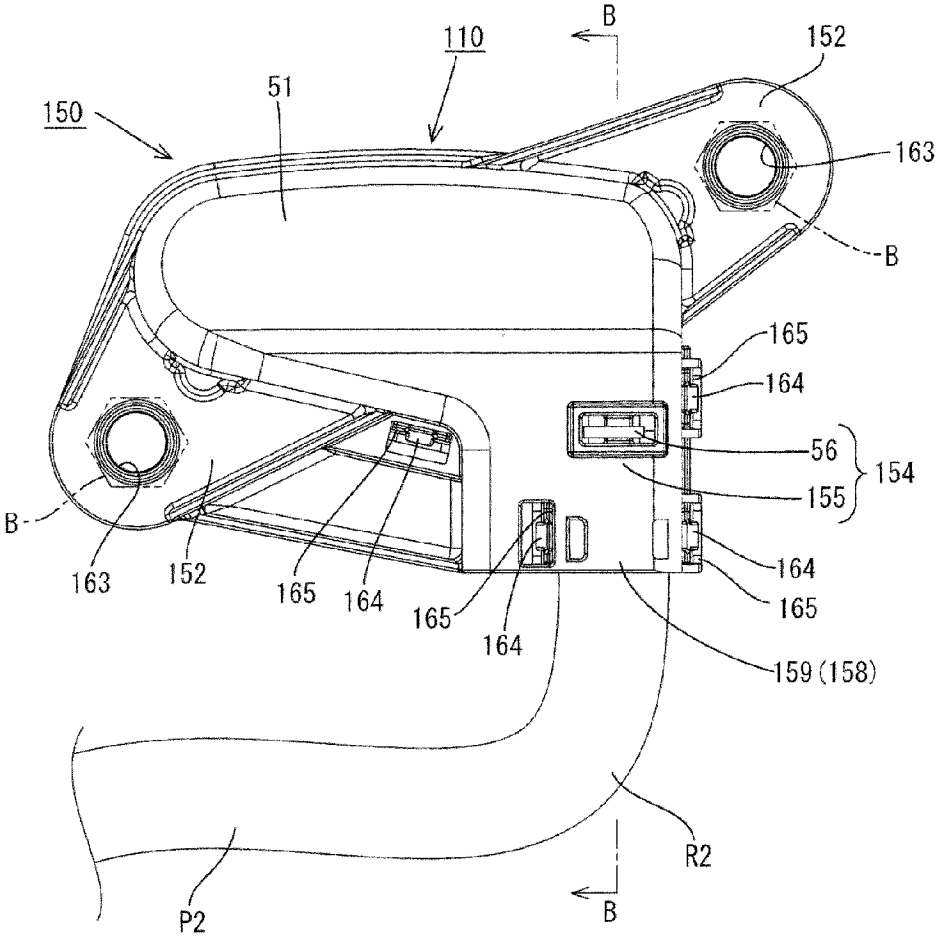
FIG. 16 is a rear view showing the state of FIG. 14.

Bulges 152 of a cover 150 of the second embodiment are shaped to cover the flange 142 of the shield bracket 140 substantially completely, as shown in FIGS. 14 to 18. Further, as shown in FIG. 13, each bulge 152 is formed with a cover-side bolt insertion hole 163 having substantially the same diameter as bolt insertion holes 143 in the flange 142 of the shield bracket 140, unlike the screw insertion holes 53 of the first embodiment. As shown in FIG. 16, the cover-side bolt insertion holes 163 are formed at positions corresponding to the bolt insertion holes 143 of the flange 142 when the cover 150 is assembled with the shield bracket 140, and the cover 150 is fixed to both the shield bracket 140 and a case of a device by inserting bolts successively through the cover-side bolt insertion holes 163 and the bolt insertion holes 143 and tightening them into the case. Specifically, according to this embodiment, it is not necessary to provide a separate part for attaching the cover 150 to the shield bracket 140 and both the cover 150 and the shield bracket 140 can be fixed to the case by one bolt tightening operation. In this way, the manufacturing cost and the number of operation steps of the connector 110 can be reduced.

Unlike the wire fixing portion 54 and the wire holding portion 58 of the first embodiment, a wire fixing portion 154 and a wire holding portion 158 of the cover 150 of the second embodiment include a lid 162 for closing a front opening of a support recess 155 and a front opening of a groove 159 together, as shown in FIG. 14.

Figure 17:
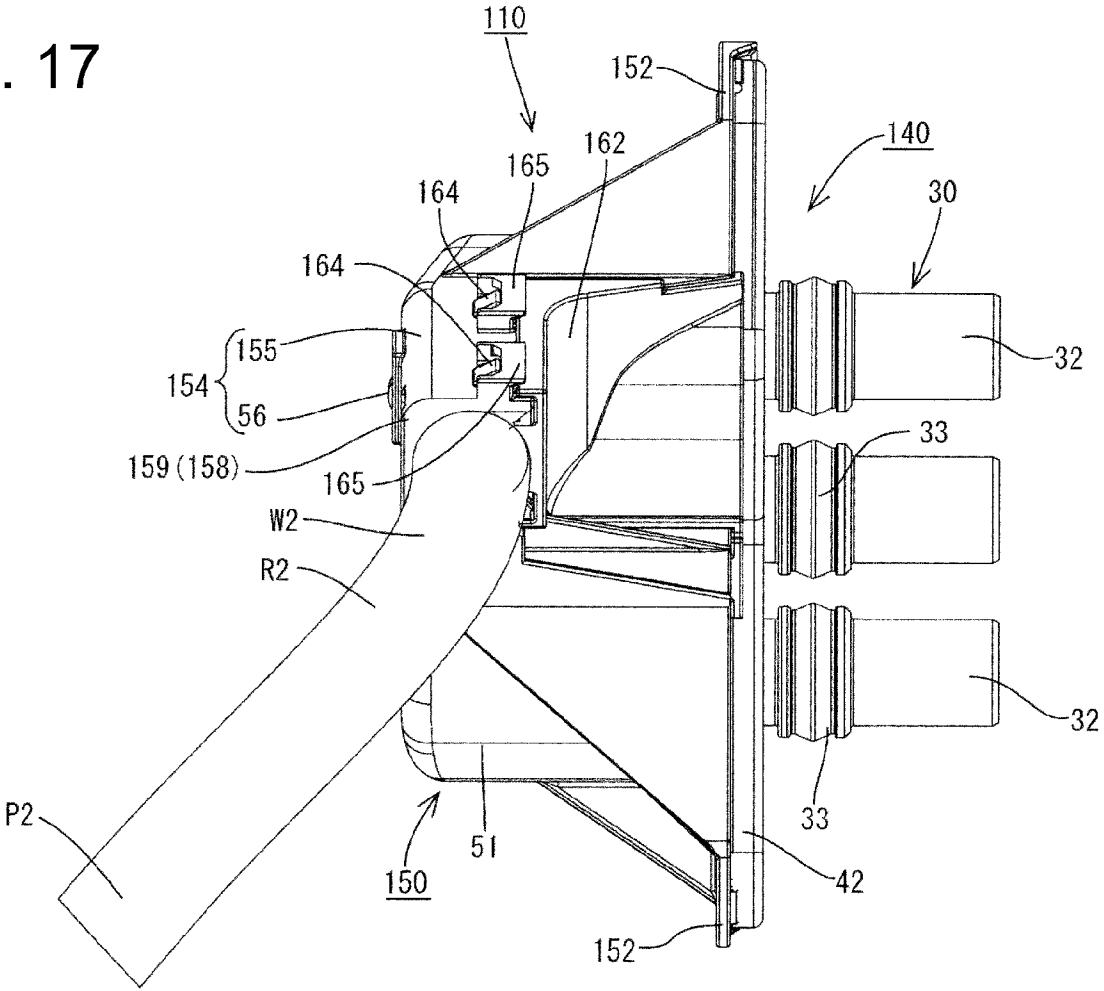
FIG. 17 is a bottom view showing the state of FIG. 14.

The lid 162 completely closes from a lower opening 51A of a covering portion 51 to a lower end of the wire holding portion 158 and is mounted on the support recess 156 and the groove 159 from the front by engaging locking projections 164 on a peripheral edge of the lid 162 with engaging portions 165 formed on the support recess 155 and the front end opening of the groove 159 as shown in FIGS. 15 to 17.

Figure 18:
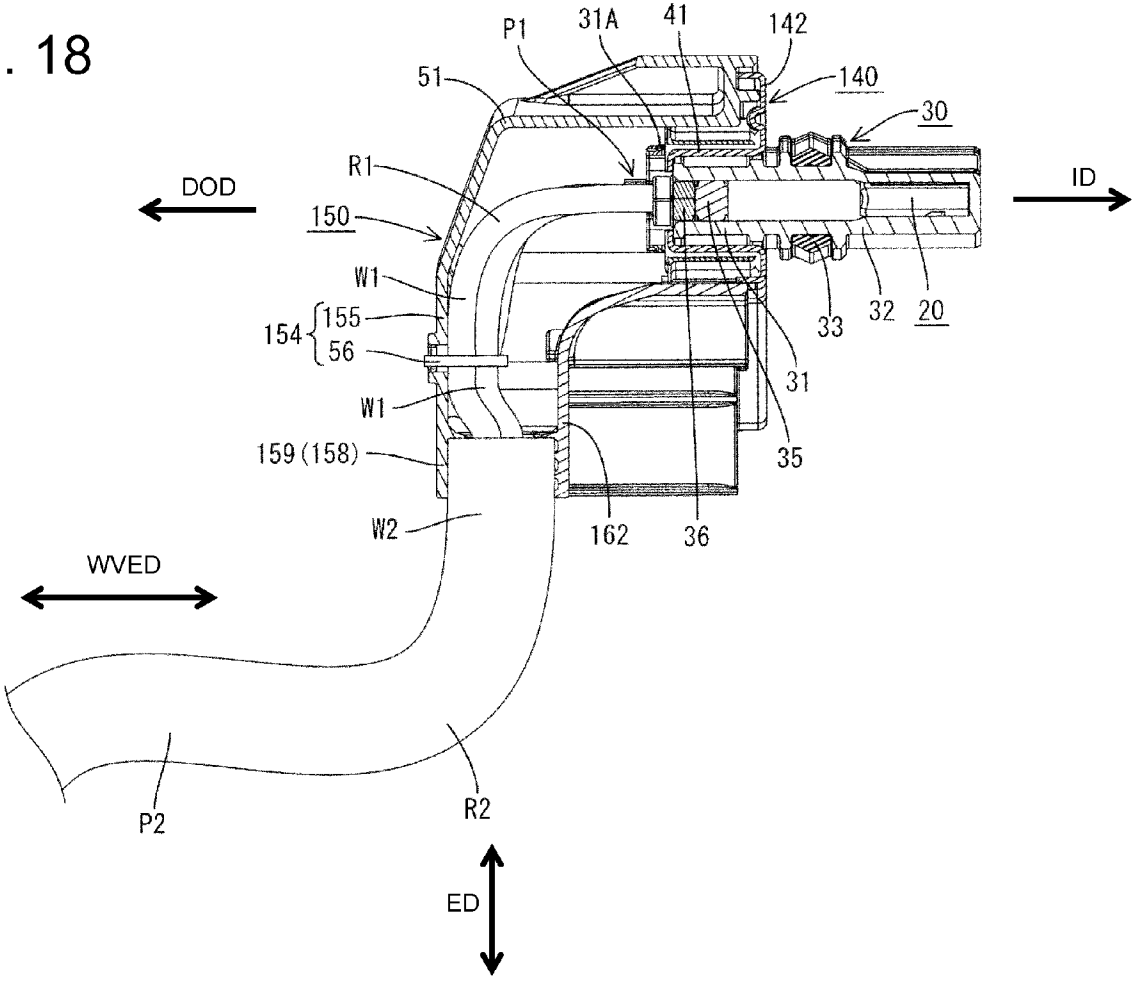
FIG. 18 is a section along B-B of FIG. 16.

Specifically, the lid 162 is assembled with the support recess 155 and the groove 159 and wires W1 from the lower opening 51A of the covering portion 51 to the lower end of the wire holding portion 158 and an end of a covering member W2 are covered over the entire circumference by the support recess 155, the groove 159 and the lid 162 as shown in FIGS. 14, 17 and 18. Even if the connector 110 is exposed to the elements, it is possible to reliably suppress the adhesion of rain and mud to the wires W1 and the end of the covering member W2. This can suppress a reduction in a fixing force for the wires W1 in the wire fixing portion 154 due to the deterioration of a housing 30 and the wires W1 resulting from the exposure of the connector 110 to the elements.

The invention is not limited to the above described embodiments. For example, the following embodiments also are included in the scope of the invention.

Although the wires W1 are fixed by tightening the support recess 55, 155 and the wires W1 by the tightening band 56 in the above embodiments, the present invention is not limited to such a mode. For example, the wires W1 may be fixed by being sandwiched by the support recess and a wire pressing portion for pressing the wires from the front opening of the support recess.

Although three wires W1 are fixed by the tightening band 56 in the above embodiments, the present invention is not limited to such a mode. For example, two or less or four or more wires W1 may be fixed by the tightening band 56.

Although the cover 50, 150 formed with the wire fixing portion 54, 154 is assembled with the shield bracket 40, 140 in the above embodiments, the invention is not limited to such a mode. For example, only the wire fixing portion may be assembled with the shield bracket.

Although the extending direction of the wires W1 in the vibrating part P2 and that of the wires W1 in the wire fixing portion 54, 154 are substantially perpendicular in the above embodiments, the present invention is not limited to such a mode. It is sufficient to cancel vibration from the vibrating part by the wire fixing portion by setting the extending direction of the wires in the vibrating part and that of the wires in the wire fixing portion to intersect with each other.

Although the extending direction of the wires W1 in the wire draw-out part P1 and that of the wires W1 in the wire fixing portion 54, 154 are substantially perpendicular in the above embodiments, the present invention is not limited to such a mode. The extending direction of the wires W1 in the wire draw-out part P1 and that of the wires W1 in the wire fixing portion 54 may be the same.

What is claimed is:

1. A connector to be mounted in proximity to a vibrating part in a vehicle, comprising:

a housing formed with cavities extending in an inserting direction;

terminal fittings inserted respectively in the cavities along the inserting direction;

wires connected respectively to the terminal fittings and extending from the housing, areas of the wires spaced from the terminal fittings being covered collectively by a covering member;

a metal shield bracket surrounding at least part of the housing and fixed to the housing and to a case of a device installed in the vehicle; and a cover including a covering portion substantially enclosing all areas of the wires extending from the housing to the covering member, bulges bulging out from the covering portion and being fixed to the housing and to the shield bracket, the cover further including a wire holding portion extending unitarily from the covering portion and being formed with a groove configured for holding the covering member of the wires press-fit in the groove and a retaining portion hinged unitarily to an opening edge of the groove and configured to rotate into a position for closing an open side of the groove and retaining the covering member and the wires collectively covered by the covering member in the groove, the cover further having a wire fixing portion configured for fixing portions of the wires extending from the covering member to the housing in an extending direction intersecting the inserting direction and intersecting an extension direction of the wires in the vibrating part, whereby the wire holding portion and the wire fixing portion suppress vibration related movement of the terminal fittings in the housing.

2. The connector of claim 1, wherein:

the bracket is fixed to the case by tightening at least one tightening member into the case; and the cover is fixed to the case by being tightened together with the bracket by the tightening member.

3. The connector of claim 1, wherein the shield bracket includes a mounting seat for attaching the cover to the shield bracket before the bracket is attached to the case.

4. The connector of claim 1, further comprising a tightening band for tightening the wires against the wire fixing portion of the cover and fixing the wires against the wire fixing portion of the cover.

5. The connector of claim 1, wherein the connector has a wire draw-out part where the wires are drawn out of the housing, and wherein the cover covers a part of the housing from the wire draw-out part to the wire fixing portion.

6. The connector of claim 5, wherein the wire holding portion includes opposed projections projecting into the groove and configured for holding the covering member in the groove.

7. The connector of claim 1, wherein the retaining portion is hinged to rotate about a hinge axis substantially parallel to the extending direction.

8. The connector of claim 7, wherein the hinge axis of the retaining portion is aligned to intersect the inserting direction.

9. The connector of claim 7, wherein the open side of the groove substantially faces the case of the device when the connector is mounted to the case of the device, and wherein the retaining portion substantially faces the case of the device when the retaining portion is rotated into the position for closing the open side of the groove.

* * * * *